United States Patent [19]

Addie

[11] Patent Number: 4,527,948

[45] Date of Patent: Jul. 9, 1985

[54] PUMP ADJUSTMENT ASSEMBLY

[75] Inventor: Graeme R. Addie, Augusta, Ga.

[73] Assignee: GIW Industries, Inc., Grovetown, Ga.

[21] Appl. No.: 438,660

[22] Filed: Nov. 3, 1982

[51] Int. Cl.[3] ..... F04D 29/08

[52] U.S. Cl. ..... 415/128; 415/171; 415/196

[58] Field of Search ..... 415/34, 126–128, 415/150, 157, 158, 171, 174, 170 R, 170 A, 171, 196

[56] References Cited

U.S. PATENT DOCUMENTS

| | | | |
|---|---|---|---|
| 678,223 | 7/1901 | Christian | 415/128 |
| 1,085,045 | 1/1914 | Holzapfel | 415/158 UX |
| 1,114,238 | 10/1914 | Doble | 415/170 A UX |
| 1,891,267 | 12/1932 | Milkowski | 415/171 |
| 3,324,800 | 6/1967 | Schroeder | 415/196 X |
| 4,208,166 | 6/1980 | Schroeder et al. | 415/171 X |
| 4,403,914 | 9/1983 | Rogo et al. | 415/150 X |

FOREIGN PATENT DOCUMENTS

| | | | |
|---|---|---|---|
| 596738 | 3/1978 | U.S.S.R. | 415/174 |

*Primary Examiner*—Robert E. Garrett
*Assistant Examiner*—Joseph M. Pitko
*Attorney, Agent, or Firm*—Newton, Hopkins & Ormsby

[57] ABSTRACT

A centrifugal pump for pumping slurries and other abrasive liquids having an axial inlet and a circumferential outlet, an impeller rotating within a housing and a suction liner secured to the housing wherein the impeller has a radial nose projecting toward the suction liner, a wear ring providing a complementary confronting surface axially spaced from said impeller and positioned as a part of a spool piece within the suction liner. The spool piece also includes a control means connected to the wear ring to move the wear ring surface axially toward and away from the impeller nose to maintain a preselected clearance therebetween to offset the abrasive wear occurring due to the pumping of the slurry.

15 Claims, 5 Drawing Figures

PUMP ADJUSTMENT ASSEMBLY

BACKGROUND OF THE INVENTION

1. Field of the Invention

This invention relates to pumps and pumping apparatus. More particularly, the present invention relates to pumps for transporting slurries and other abrasive containing fluids in the use of centrifugal pumps. The invention is particularly concerned with controlling the effect of the inherent wear that is characteristic for centrifugal pumps used for transporting slurries and abrasive-containing fluids.

2. The Prior Art

Slurry pumps are used in many fields such as dredging waterways, transportation of fluidized solids and the like. Such pumps also have been used for many years and typically include an impeller that is designed with a nose formed by a radial projection facing towards the suction side of the pump and extending a short distance radially outwardly from the axis of the impeller. This impeller nose is provided with a nose surface that is perpendicular to the axis of the impeller and confronts a complementary surface that is integral with the suction liner formed as a separate part of the housing of the pump. There must be a clearance referred to in the art as the "impeller nose clearance" between the impeller nose surface and the confronting suction liner surface. This nose clearance or gap is typically specified by the manufacturer of the pump and may vary in accordance with the size of the pump, however, usually is in the range of about 1/32 of an inch when the pump is new. When the pump is used to transport the slurries and other solid-containing liquids, the abrasive conditions wear the confronting surfaces to such an extent that the impeller nose clearance increases dramatically causing a loss of efficiency due to the slurry not being controlled by the action of the impeller, and as the nose clearance becomes greater, more of the slurry and abrasive-containing liquid passes through the gap causing even greater wear and increasing the gap substantially to the point that the pump becomes inefficient and ineffective. At the time that such a drop in efficiency is noted, the pump must be stopped, thus ceasing the pumping operations of the liquid slurry and the pump must be dismantled and either or both the impeller or suction liner being replaced. This procedure is an expensive and time-consuming operation primarily for the reason that the pumping operation must cease during the period of correcting the oversized gap.

The prior art pumps had an integral construction of the suction liner with the portion forming the nose clearance with the impeller nose. Thus, simple adjustments to correct the nose clearance were not possible and the costly and uneconomical shutdowns could not be averted.

OBJECTS OF THE INVENTION

The principal object of the present invention is to provide a centrifugal pump for slurries and abrasive liquids that allows the correction of the wear of the nose clearance and prevents the pump stoppages and costly maintenance heretofore common in the industry for this type of pump.

Another object of the present invention is the provision of a suction liner that is not integral with the portion of the pump forming the nose clearance.

It is a further object of the present invention to provide a movable nose piece separate from the suction liner that is adjustable to control the impeller nose clearance while the pump is running.

It is also an object of the present invention that the adjustable nose piece takes the form of a spool piece that is not integral with the suction liner and therefore may be moved towards the impeller nose to maintain the nose clearance at the proper magnitude.

It is also an object of the present invention to provide control means for moving the nose piece toward the impeller nose and to do so uniformly with the movement of a single circumferentially positioned spacer means.

This invention also has as an object the provision of a plurality of circumferentially positioned spacer means for uniformly controlling the movement of the nose piece to maintain the proper gap for the impeller nose clearance.

The invention also is intended to provide a spool piece that may be utilized at the intake side of any standard impeller pump with only minor modifications to permit maintenance of the nose clearance without necessitating the dismantling of the pump or even interrupting the continuity of operation.

The present invention has as a more general object the provision of an adjustable nose assembly that may be attached to a slurry pump simply and easily to correct at any time during the running of the pump, the impeller nose clearance while avoiding costly shutdowns and thus increasing the wear life and the hydraulic performance of the pump.

SUMMARY OF THE INVENTION

A centrifugal pump for pumping slurries in which the nose clearance at the impeller nose is controlled by a movable nose piece that may be secured to the pump under the suction liner. The nose piece is adjustable to move towards the impeller nose to maintain a proper nose clearance and includes a wear ring and a wear ring holder carried by an outer barrel casing to form a flanged spool piece. The movement of the wear ring to control the impeller nose clearance is varied by a control means connected to the wear ring that moves the wear ring surface axially toward the nose piece. The control means includes a plurality of circumferentially positioned spacer means to control the movement of the wear ring. Each spacer means includes a sprocket and an endless connector operative upon each spacer means to assure identical movement of all spacer means by reason of the movement of a single spacer means.

DESCRIPTION OF THE PREFERRED EMBODIMENT

Figure 2:
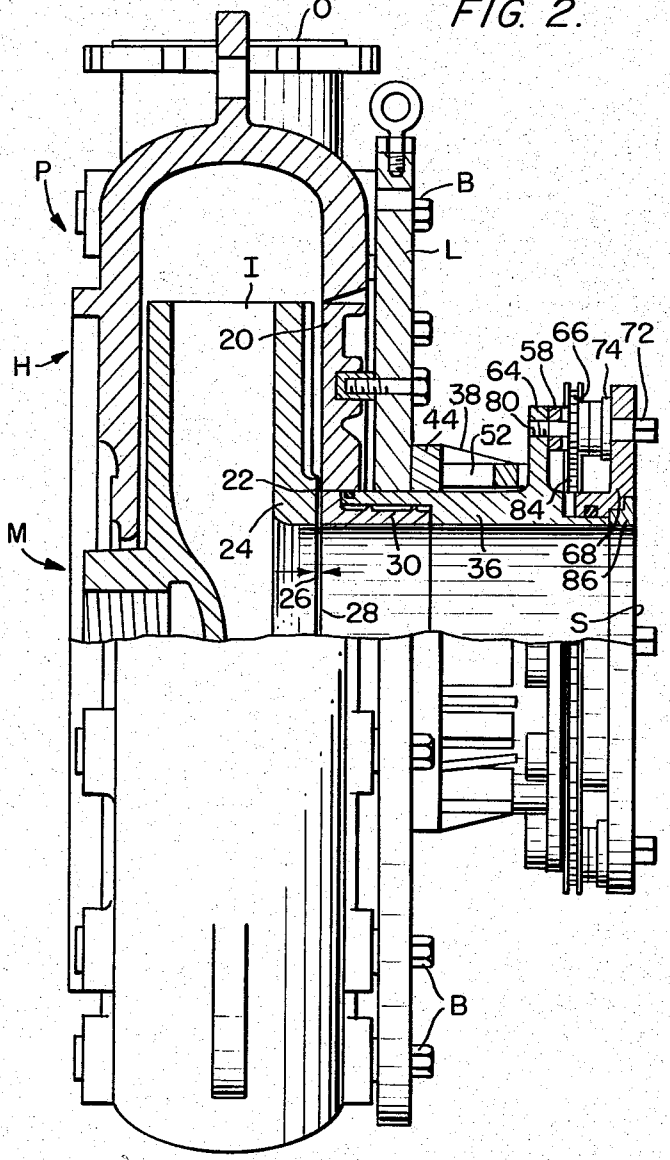
FIG. 2 is an end view of the slurry pump of the present invention partly broken away and sectioned to illustrate the spool piece assembly for positioning below the suction liner.
Figure 1:
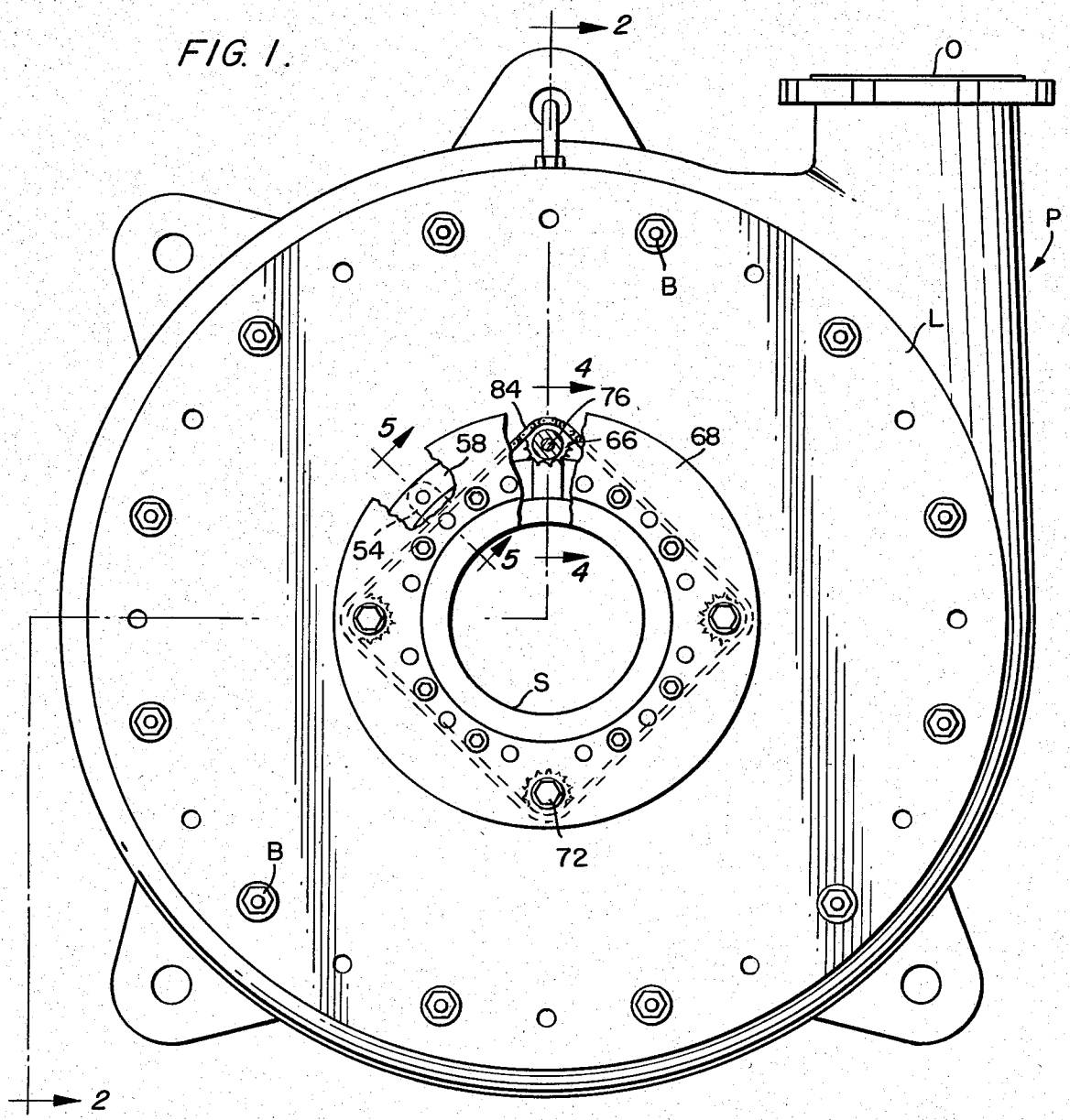
FIG. 1 is a side elevational view partly broken away of the slurry pump of the present invention illustrating the endless connector for the spacer means to effect identical movement of all spacer means by movement of any single one.

In the drawings FIGS. 1 and 2 disclose the overall configuration of the end suction, radially split centrifugal pump P of the present invention. The centrifugal pump P includes an outlet O and a suction inlet S. Mounting M is for the motor (not shown) to rotate the impeller I of the centrifugal pump P of the present invention. The impeller I rotates about the axis of and within a pump housing H and forms the communication between the suction inlet S for the slurry and the pressurized slurry leaving the outlet O. A suction plate L is provided to the front of the pump held in place by bolts B.

The centrifugal pump of the present invention as described generally above constitutes the essential parts of a convenional pump. Prior art pumps, however, extended a removable suction liner 20, forming part of the housing H and bolted to the suction plate L, further towards the axis of the pump. A surface positioned on the suction liner confronted the impeller nose surface. This latter surface is perpendicular to the rotating axis of the propeller facing towards the suction inlet S while forming a part of the impeller nose. In the past, the impeller nose surface and a confronting surface of the suction liner would form an impeller nose clearance or gap that would increase in magnitude as the pump was operating with more of the slurry passing from the low pressure, or suction side, to the high pressure, or outlet side, through the gap, thus, not only losing efficiency and effectiveness, but also providing a basis for greater wear as there is a greater flow of the abrasive slurry.

Figure 4:
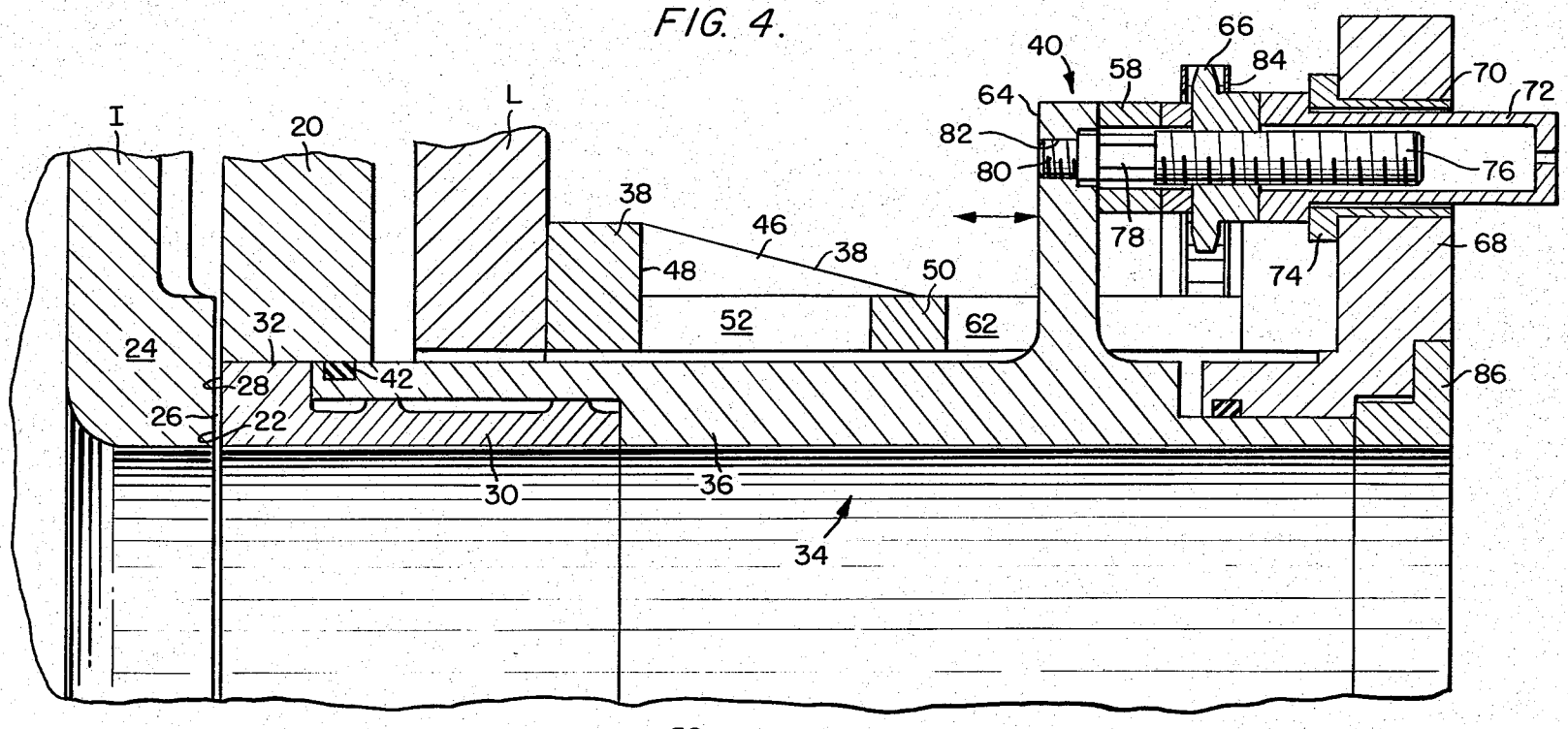
FIG. 4 is a view of the centrifugal pump of the present invention taken along lines 4—4 of FIG. 1 illustrating with greater particularity the spool piece assembly and its positioning with respect to the impeller nose and impeller nose clearance and additionally illustrating the positioning of the spool piece assembly within the suction liner as well as the details of the spacer means.

In the present invention as shown in FIG. 4, the radially disposed, circular, impeller nose surface 22 is one of the confronting surfaces that forms the impeller nose clearance shown at 26. This nose clearance can be of any shape depending upon the shape of the confronting surfaces. in magnitude the impeller nose clearance is generally in the range of about 1/32 of an inch, though the particular clearance is not critical and may vary with different pumps for a variety of reasons. Neither the particular magnitude, nor the shape of the impeller nose clearance forms an aspect of the present invention, rather only the means for forming and maintaining whatever impeller nose clearance is preselected.

As shown in FIGS. 2 and 4, the impeller nose clearance 26 is formed with the aid of a confronting radially disposed, circular, wear ring surface 28 positioned on a flanged surface of a cylindrical wear ring 30 positioned coaxially with the impeller I and with the upstanding flange portion 32 providing the wear ring surface 28.

The wear ring 30 forms a part of a spool piece assembly that is adapted to slide under the suction liner 20 and under the suction plate L. This is accomplished in any conventional centrifugal pump by enlarging the diameter of the opening of the suction liner 20 to accommodate the spool piece assembly 34.

Figure 3:
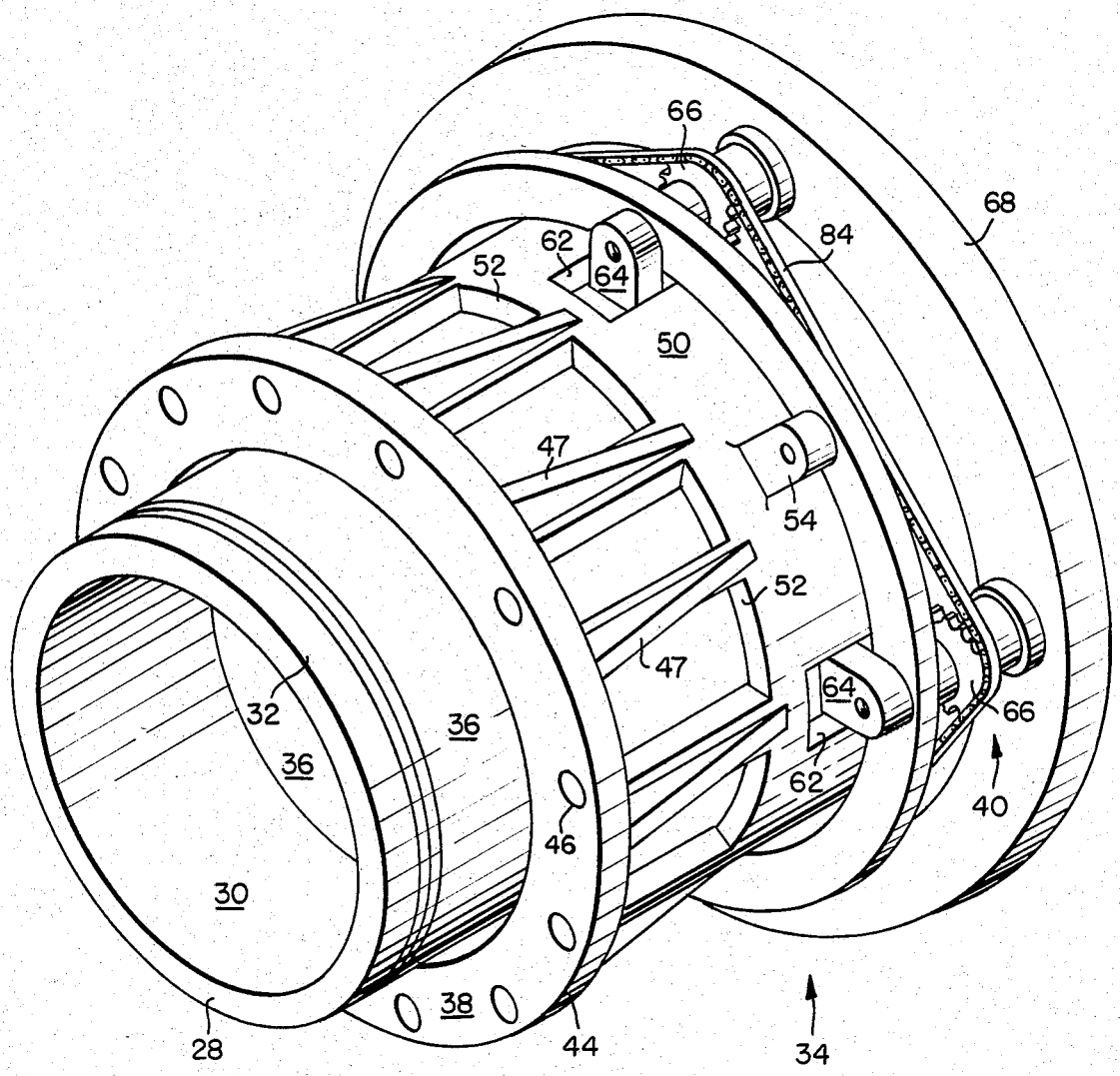
FIG. 3 is a perspective view of the spool piece assembly of the centrifugal pump of the present invention illustrating the outer barrel casing surrounding and retaining the wear ring holder and wear ring and also illustrating the spacer means and accompanying sprocket means being operative by the endless connector means.

As best shown in FIGS. 3 and 4 the spool assembly 34 includes the wear ring 30 and the wear ring holder 36, the outer barrel casing 38 and the control means 40 to assure the uniform movement of the wear ring and therefore the wear ring surface 28 towards the impeller nose surface 22 to maintain a preselected impeller nose clearance 26.

The outer barrel casing 38 of the spool piece assembly 34 may be secured in any conventional manner to the outer surface of the suction plate L and has a diameter sufficient to receive the wear ring holder 36. The inner end portion of the wear ring holder 36 telescopically receives the wear ring 30. As seen in FIG. 2, the inside diameter of the wear ring holder 36 is a hollow cylindrical tubular member. The inside diameter of the wear ring 30 and the wear ring holder 36 are essentially the same and the outside diameter of the ring 30 and the outside diameter of the inner end portion of the holder 36 are essentially the same. The wear ring holder 36 is provided with a conventional O-ring 42 to prevent leakage of the slurry liquid between the suction liner and the wear ring and wear ring holder.

The outer barrel casing 38 is provided with an upstanding flange portion 44 in which is formed a plurality of circumferentially spaced bolt holes 46 for securing the outer barrel casing to the suction plate with stud bolts (not shown). The outer barrel casing flange 44 is supported for greater strength by a plurality of angle supports 47 which contact the outer face of the outer barrel casing flange 44 at 48. The outer barrel casing 38 has an elongated cylindrical body 50 provided with a plurality of circumferentially spaced openings 52 positioned between the angle irons 47.

Figure 5:
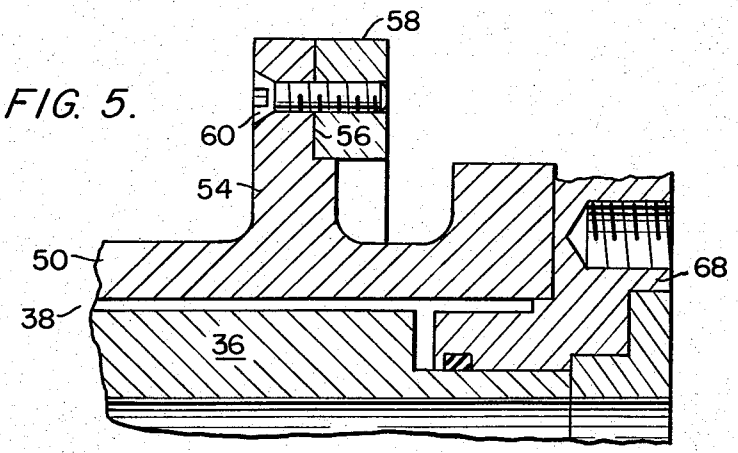
FIG. 5 is a fragmented sectional view taken along lines 5—5 of FIG. 1 illustrating the relationship between the sprocket gear holder and the outer barrel casing as well as the wear ring holder and end cover.

As particularly shown in FIGS. 3, 4 and 5 the outer barrel casing 50 is provided with a plurality of upstanding bosses 54. Each boss 54 is formed with a cutout portion 56 as shown in FIG. 5 to receive a ring-shaped sprocket gear holder 68. This sprocket gear holder is secured to the bosses 54 by a plurality of cap screws 60 received in suitable accommodating bores through each boss 54 and the sprocket gear holder 58 as shown in the fragmentary view of FIG. 5.

The outer barrel casing body 50 is provided with a plurality of slots 62 circumferentially arranged around the outer barrel casing body to receive slidably, the wear ring holder boss 64 in each of the slots 62. The wear ring holder boss 64 is spaced circumferentially about the wear ring holder 36 and extends radially outwardly as best shown in FIGS. 3 and 4 to enable the control means 40 to effect movement of the wear ring holder 36, and therefore wear ring 30 towards the impeller to maintain the impeller nose clearance.

The control means 40 operates upon each of the wear ring holder bosses 64 so as to move the wear ring uniformly. In order to achieve this uniformity of movement, a plurality of sprockets 66 are circumferentially positioned around the end cover 68 and protrude through suitable openings 70 in the end cover to permit the shanks 72 of each of the threaded sprocket gears 66 to extend outwardly from the end cover 68 as best shown in FIG. 4. Outside spacer bushings 74 receive each of the shanks 72 within its respective opening 70.

Each of the sprockets 66 is internally threaded to receive a threaded sprocket gear stud 76 which extends through the hollow hex-headed shank 72 at one end and at the other end is necked down at 78 to fit within an accommodating bore in the sprocket gear holder 58 and is further necked down to a screw thread as shown at 80 forming the other end of the stud 76. The necked down screw stud portion 80 is received into an accommodating threaded bore positioned within the wear ring holder boss 64. The construction and arrangement is such that rotation of the sprocket 66 in one direction rotates the stud 76 for longitudinal movement to the left as shown in FIG. 4 to effect operative movement of the wear ring holder 36 through contact with the boss 64 and thus to move the wear ring and contiguous wear ring surface 28 closer to diminish the impeller nose clearance.

To effect the movement of the stud 76 in a uniform manner so that the wear ring holder is uniformly moved and thus the wear ring surface uniformly moved, each of the circumferentially spaced sprockets constitutes a spacer means forming together a control means to provide for movement of the wear ring. These sprockets 66 are operative together by the connector in the form of the endless chain 84.

Thus, any rotational movement imparted to any one of the hex-headed shanks 72 protruding from the end cover 68 necessarily rotates the connector chain 84 that imparts identical movement to each of the other sprockets forming the other spacer means. In turn, each of these spacer means is provided with identical studs 76 and cooperates in exactly the same manner as previously described to contact the wear ring holder boss 64 to control the movement of the wear ring holder uniformly, and urge the wear ring surface towards the impeller nose surface 22 to control the impeller nose clearance.

As shown, the entire spool piece assembly can be simply added to the conventional pump by enlarging the diameter of the suction liner 20 at the suction inlet. It is possible also for the outer barrel casing, instead of being bolted to the suction plate, to be formed as an integral part with the suction plate.

It is one of the unique features of the present invention that adjustment of the pump and the maintenance of a proper impeller nose clearance is achieved while the pump is running simply by rotating one of the four shanks 72 of the spacer means.

The parts of the control means are protected by the end cover to which is added at the suction entrance an additional wear ring 86 as shown in FIG. 4. Depending upon the length of the stud 76 and the movement permitted for the boss 64 within the outer barrel casing the adjustment of the wear ring is possible up to one inch all without the necessity of dismantling the pump or stopping the operation.

It is believed that the objects of the present invention have been met and therefore the scope of the invention should be limited solely by the appended claims wherein

I claim:

1. A centrifugal pump having a housing provided with an axis, an impeller rotatably disposed within said housing for rotation about said axis, said housing having a suction inlet along said axis and a discharge radially outwardly of said inlet, wherein the improvement comprises:

(a) said impeller being provided with first circular surface adjacent to said inlet;

(b) a cylindrical wear ring having, at its inner end, a second circular surface conforming to and abutting said first circular surface;

(c) a hollow tubular wear ring holder receiving, in the inner end portion thereof, the outer end portion of said wear ring for holding said wear ring for movement with said wear ring holder, said wear ring holder being telescopically received within the inlet of said housing for movement axially toward and away from said impeller; and (d) control means connected to said wear ring holder for incrementally moving said wear ring holder toward and away from said impeller.

2. The centrifugal pump defined in claim 1 wherein said wear ring holder is cylindrical and defines a portion of said inlet.

3. The centrifugal pump defined in claim 2 wherein said control means includes a plurality of circumferentially spaced bosses fixed at their inner ends to said wear ring holder, said bosses extending outwardly of said housing, an end cover connected to said housing and extending radially therefrom, said end cover being axially spaced from said bosses, sprockets respectively disposed between said bosses and said end cover, studs respectively received by said sprockets, for moving said bosses upon rotation of said sprockets, and a chain engaging all of said sprockets for simultaneously rotating said sprockets upon movement of said chain.

4. The centrifugal pump defined in claim 3 wherein said control means also includes means for driving said chain.

5. The centrifugal pump defined in claim 1 wherein said control means includes a plurality of radially extending, outwardly protruding, circumferentially spaced, bosses connected by their inner ends to said wear ring holder, said bosses protruding outwardly through said housing, and means connected between said housing and said bosses for moving said wear ring holder.

6. The centrifugal pump defined in claim 5 wherein the means connected between said housing and said bosses for moving said wear ring holder includes a plurality of sprockets respectively positioned between said housing and said boses, threaded studs connected to said sprockets for imparting longitudinal motion to said bosses upon rotation of said sprocket, and a chain extending around all of said sprockets for simultaneously rotating them when said chain is moved.

7. The centrifugal pump defined in claim 1 including a suction liner secured to the inner portion of said housing, said suction liner having an opening in its central portion receiving the inner end portion of said wear ring holder and also receiving a portion of said wear ring in said opening.

8. The centrifugal pump defined in claim 7 including an O-ring disposed between said suction liner and the inner end portion of said wear ring holder.

9. The centrifugal pump defined in claim 1 including axially spaced O-rings around said wear ring holder for arresting the flow of fluid from the interior of said housing outwardly around the periphery of said wear ring holder.

10. The centrifugal pump defined in claim 1 wherein said housing includes a suction liner secured to the interior of said housing, said suction liner surrounding said wear ring and the inner end portion of said wear ring holder.

11. The centrifugal pump defined in claim 1 wherein a front portion of said wear ring is recessed into and concentrically received within the end portion of said wear ring holder.

12. The centrifugal pump defined in claim 11 wherein the inside diameter of said wear ring holder and said wear ring are substantially the same.

13. The centrifugal pump defined in claim 12 wherein the outside diameter of said inner end portion of said wear ring holder and the outside diameter of said wear ring are substantially the same.

14. The centrifugal pump defined in claim 13 in which said housing includes a suction liner surrounding said wear ring and a portion of said end portion of said wear ring holder.

15. The centrifugal pump defined in claim 14 wherein the wear surface of said impeller extends radially over the inner portion of said suction liner.

* * * * *